US009457401B2

(12) United States Patent
Tacheny et al.

(10) Patent No.: US 9,457,401 B2
(45) Date of Patent: Oct. 4, 2016

(54) RISER BREAKER ASSEMBLY

(71) Applicant: LGT Manufacturing Co., Inc., Mankato, MN (US)

(72) Inventors: James G. Tacheny, Mankato, MN (US); Adam Tacheny, Mankato, MN (US)

(73) Assignee: LGT Manufacturing Co., Inc., Mankato, MN (US)

( * ) Notice: Subject to any disclaimer, the term of this patent is extended or adjusted under 35 U.S.C. 154(b) by 273 days.

(21) Appl. No.: 13/902,295

(22) Filed: May 24, 2013

(65) Prior Publication Data

US 2013/0313300 A1 Nov. 28, 2013

Related U.S. Application Data

(60) Provisional application No. 61/651,023, filed on May 24, 2012.

(51) Int. Cl.
*B22D 31/00* (2006.01)
*B26F 3/02* (2006.01)

(52) U.S. Cl.
CPC ..... *B22D 31/00* (2013.01); *B26F 3/02* (2013.01); *Y10T 225/10* (2015.04); *Y10T 225/371* (2015.04)

(58) Field of Classification Search
CPC ... B22D 31/00; B26F 3/02; B29C 2049/725; B29C 49/72; B29C 49/74; B29C 37/02; Y10T 225/371; Y10T 225/10
USPC ..... 225/1
See application file for complete search history.

(56) References Cited

U.S. PATENT DOCUMENTS 1,112,146 A * 9/1914 Ladd ..... 225/97
2,449,561 A * 9/1948 McGary et al. ..... 30/251
3,196,727 A * 7/1965 Pray ..... 83/601
3,205,747 A * 9/1965 Guth ..... 83/605
3,239,327 A * 3/1966 Stroud, Jr. et al. ..... 65/334
3,269,623 A * 8/1966 Janik ..... 225/1
3,307,760 A * 3/1967 Meese et al. ..... 225/1
3,450,319 A * 6/1969 Campbell, Jr. ..... B67B 7/92 225/104
3,793,421 A * 2/1974 Paubandt ..... 264/527
3,866,522 A * 2/1975 Oswalt, Jr. ..... 72/324
4,069,584 A * 1/1978 Germain ..... 30/238
4,297,931 A * 11/1981 Lessard ..... 83/397
4,570,838 A * 2/1986 Szemere ..... B67B 7/92 225/93
4,576,380 A * 3/1986 Shields ..... 225/104
4,685,602 A * 8/1987 Hama ..... 225/93
4,700,760 A * 10/1987 Weingarten ..... 164/244
4,717,296 A * 1/1988 Phillips ..... 409/132
4,805,507 A * 2/1989 Schmidt et al. ..... 83/601
5,040,590 A * 8/1991 Brandriff ..... 164/118
5,086,961 A * 2/1992 Angel et al. ..... 225/1
5,154,333 A * 10/1992 Bauer et al. ..... 225/1
5,161,583 A * 11/1992 Ackerman ..... 140/93 A
5,297,710 A * 3/1994 Juras ..... C03B 33/033 225/105
5,375,330 A * 12/1994 Herrmann ..... 30/228
5,630,538 A * 5/1997 Hatakeyama ..... B22D 31/00 164/262
5,934,166 A * 8/1999 Herlihy ..... 83/605
6,832,703 B1 * 12/2004 Scott ..... B67B 7/92 222/1
7,137,328 B1 * 11/2006 Tilton ..... 83/527
8,448,830 B2 * 5/2013 Starr ..... B67B 7/92 225/103

(Continued)

*Primary Examiner* — Sean Michalski
(74) *Attorney, Agent, or Firm* — Dicke, Billig & Czaja, PLLC

(57) ABSTRACT

A tool assembly includes an actuator and a bearing surface. The actuator places a force with the bearing surface on a riser connected to a workpiece to separate the riser from the workpiece.

6 Claims, 8 Drawing Sheets

(56) References Cited

U.S. PATENT DOCUMENTS 8,584,918 B2 * 11/2013 Su ..... B26F 3/002 225/23
9,114,452 B2 8/2015 Mangoyan
2002/0158099 A1 * 10/2002 Matsuoka ..... B23D 31/003 225/96.5
2002/0190092 A1 * 12/2002 Salmi ..... B21C 37/0803 225/103
2003/0089753 A1 * 5/2003 Hang ..... 225/1
2008/0022795 A1 * 1/2008 Newcomb ..... B22D 31/00 74/144
2009/0071994 A1 * 3/2009 Jans ..... 225/1
2009/0277941 A1 * 11/2009 Riverstone ..... 225/1
2012/0104064 A1 * 5/2012 Nishikuma et al. ..... 225/1
2013/0174607 A1 * 7/2013 Wootton et al. ..... 65/29.18
2013/0284785 A1 * 10/2013 Brosius ..... 225/1
2014/0069979 A1 * 3/2014 Kruzel ..... 225/1
2014/0215834 A1 * 8/2014 Wang ..... 30/251
2014/0263531 A1 * 9/2014 Liu ..... B67B 7/92 225/105
2014/0332577 A1 * 11/2014 Hansmaier et al. ..... 225/2

* cited by examiner

RISER BREAKER ASSEMBLY

CROSS-REFERENCE TO RELATED APPLICATIONS

This application claims priority under 35 U.S.C. §119(e) to U.S. Provisional Patent Application Ser. No. 61/651,023 filed on May 24, 2012, and incorporated herein by reference.

BACKGROUND

Casting involves the use of a mold where liquid material is poured into the mold and the material is allowed to solidify. In some instances, risers are used in the mold to form a reservoir that assists in preventing irregularities in the casting. Upon cooling of the casting, the risers are removed from the remainder of the casting. Current techniques for removal of the riser involve striking the riser with a maul, which can be time consuming, prone to difficulty and present safety concerns due to the potential for a rapid and erratic ejection of the riser from the casting.

SUMMARY

Disclosed herein are concepts for removing a riser from a workpiece. An actuator having a first bearing surface provides a force against the riser. A second bearing surface is positioned on an opposite side of the first bearing surface and is provided to constrain movement of the riser upon separation from the workpiece. A contact surface can be utilized to secure the workpiece during removal of the riser.

In one embodiment of the concepts disclosed herein, a tool assembly includes a base assembly coupled with an actuator that moves linearly with respect to the base assembly. A breaker assembly coupled to the actuator includes a linkage and a bearing surface. The linkage is pivotally coupled with the actuator. The bearing surface transitions from a first position to a second position upon pivoting of the linkage.

Another embodiment includes a method of separating a riser from a workpiece. The method includes providing an actuator, a first bearing surface, a second bearing surface and a contact surface. The workpiece is secured using the contact surface. The riser is positioned in contact with the first bearing surface and the actuator applies a force at the first bearing surface so as to separate the riser from the workpiece. The second bearing surface is positioned to constrain movement of the riser upon separation from the workpiece.

Yet a further embodiment includes a breaker assembly for coupling to a tool assembly. The breaker assembly includes a bracket assembly configured to be coupled to the tool assembly. An actuating member is moveable with respect to the bracket assembly from a first linear position to a second linear position. A linkage is pivotally coupled to the bracket assembly and a plurality of link arms are connected to the linkage. A bearing surface coupled to the linkage transitions from a first position to a second position relative to the actuating member as the actuating member moves from the first linear position to the second linear position.

DETAILED DESCRIPTION OF THE INVENTION

Figure 1:
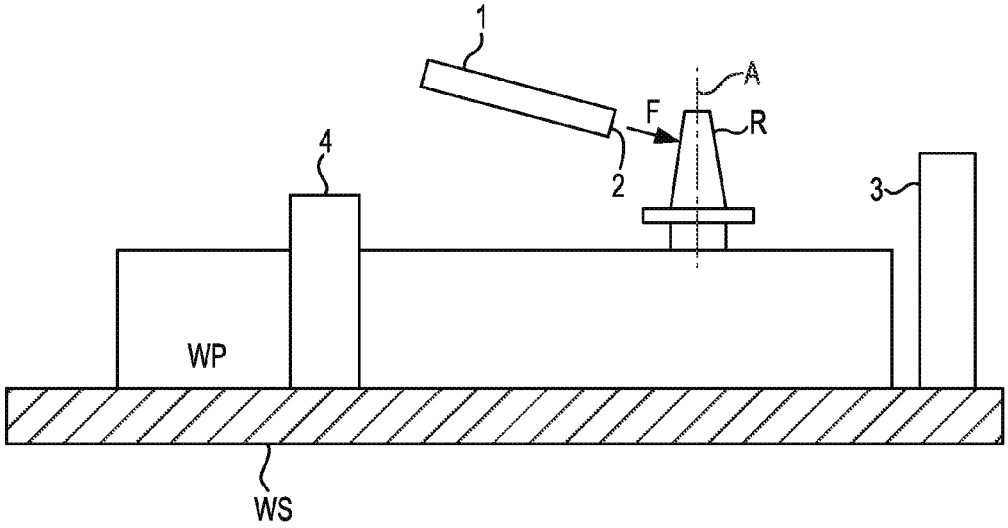
FIG. 1 is a schematic view of components for removing a riser from a workpiece.

FIG. 1 is a schematic overview of one embodiment of an inventive assembly for safely and efficiently removing a riser from a workpiece. As illustrated, a workpiece (WP) is positioned and supported on a working surface (WS). The workpiece (WP) includes a riser (R) connected thereto. To remove the riser (R) from the workpiece (WP), an actuator 1 having a bearing surface 2 provides a force (F) to one side of the riser (R). The actuator 1 can be driven by a source of power such as manual, electric, pneumatic and/or hydraulic power. In one embodiment, the actuator moves linearly toward the riser at an angle relative to the axis (A) of the riser (R), e.g., such as an angle of about 90°, although other angles that are relatively transverse to the axis (A) will suffice. Once the actuator 1 makes contact with the side of riser (R), the actuator applies a force sufficient to axially displace the riser. In one embodiment, movement of the riser (R) a distance of about ⅛ inch from its axis (A) results in separation of the riser (R) from the workpiece (WP).

A second bearing surface 3 is positioned on an opposite side of the riser (R) from the first bearing surface 2. The second bearing surface 3 is located and configured to constrain movement of the riser (R) upon separation from the workpiece (WP). In one embodiment, the second bearing surface 3 is positioned in fixed, spaced relation to the first bearing surface 2. Alternatively, the second bearing surface 3 is movable relative to the first bearing surface 2 to adjust the distance between the two respective bearing surfaces. In one embodiment, the second bearing surface 3 is in contact with the riser (R) generally opposite the point of contact of the first bearing surface 2. In one embodiment, the second bearing surface 3 can be directly coupled to the working surface (WS). In an alternative embodiment, the second bearing surface 3 can be directly coupled with the first bearing surface 2 in order to control movement of the riser (R) upon separation from the workpiece (WP).

A contact surface 4 is also provided to secure movement of the workpiece (WP) to allow the movement of the actuator 1 to cause the separation of the riser (R) from the workpiece (WP). In one embodiment, the contact surface 4 can be directly coupled to the working surface so as to secure the workpiece (WP) to the working surface (WS). In one embodiment, the contact surface 4 comprises a right angle bracket with one leg of the bracket connected to the working surface (WS) and the angled leg above and in close proximity to the upper surface of the workpiece (WP). As such, the workpiece (WP) is positionable with a portion of the workpiece located underneath the angled leg of the bracket, yet the workpiece is constrained from movement when the actuator 1 applies force against the riser (R). In an alternative embodiment, the contact surface 4 comprises a clamping mechanism that contacts a top and bottom surface of the workpiece (WP). Alternatively, the contact surface 4 can be directly coupled with the actuator 1 so as to provide force sufficient to separate the riser (R) from the workpiece (WP).

Figure 2:
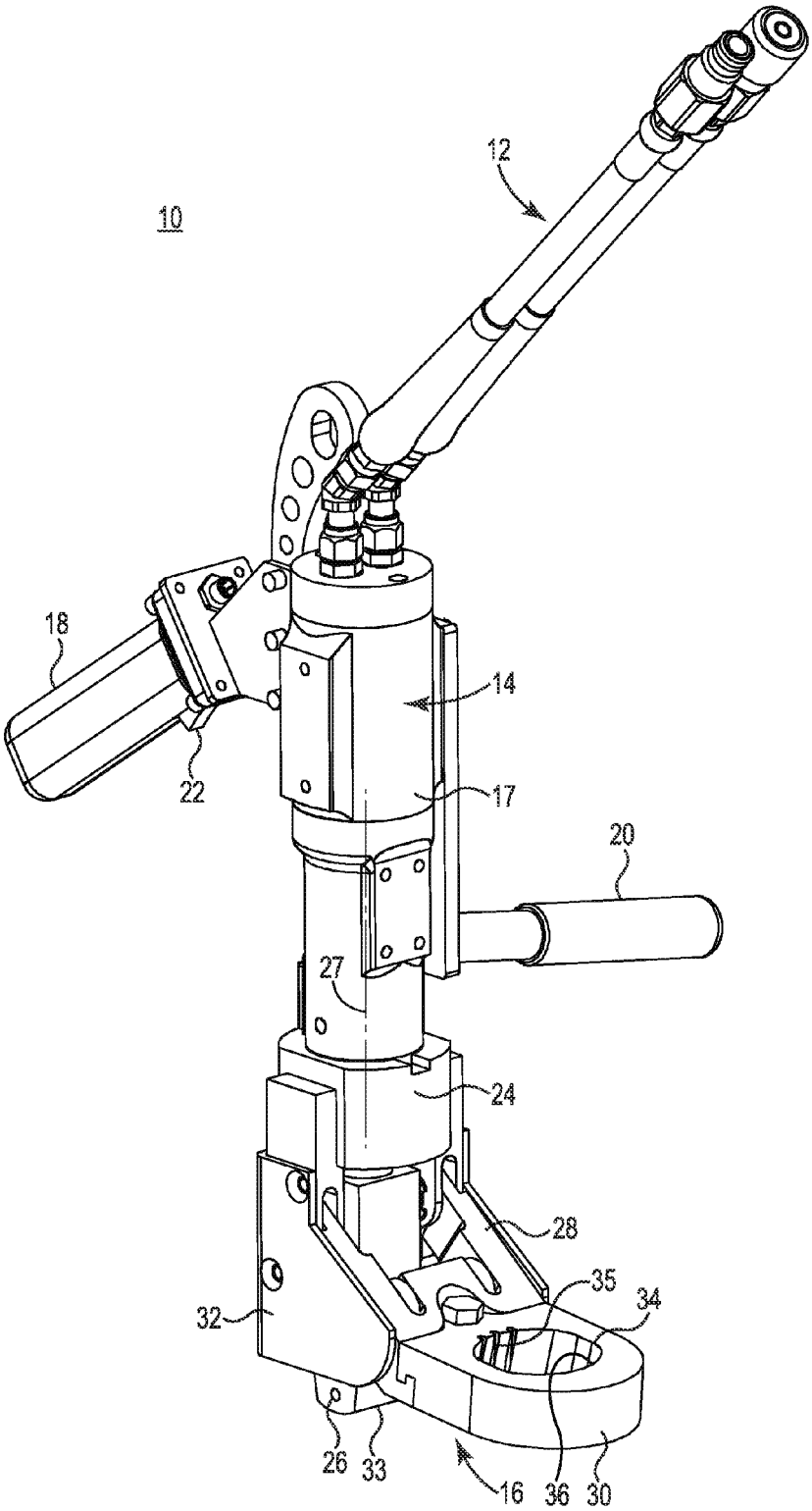
FIG. 2 is an isometric view of a hydraulic tool assembly.

FIG. 2 illustrates a tool assembly 10 that makes use of the inventive concept disclosed in FIG. 1. Tool assembly 10 includes a fluid delivery assembly 12, a body or base assembly 14 and a breaker assembly 16. Fluid delivery assembly 12 carries hydraulic fluid to and from a hydraulic power unit (not shown) in order to drive the tool assembly 10. Other means of powering tool assembly 10 can be utilized as desired such as pneumatic, electric, etc. Body assembly 14 includes a housing 17, a first handle 18 and a second handle 20. Housing 17 defines an internal chamber that receives fluid from the fluid delivery assembly 12. The handles 18 and 20 are designed to be grasped by a user to move the breaker assembly 16 to a desired position. Handle 18 maintains a trigger assembly 22 that can be depressed in order to actuate the tool assembly 10 as will be discussed below.

Breaker assembly 16 includes a bracket assembly 24 coupled to the housing 17. The breaker assembly 16 further includes an actuating member 26 moveable with respect to the bracket assembly 24 along a linear axis 27. The actuating member 26 is connected with a receiver linkage 28 and a breaker bit 30. An optional guard 32 surrounds the receiver linkage 28 and bracket assembly 24. Details of the breaker assembly 16 are provided below. In general, however, the breaker assembly 16 defines a contact surface, a first bearing surface and a second bearing surface. During operation, the contact surface is brought into contact with a workpiece and the first bearing surface and second bearing surface are positioned on opposed sides of a riser coupled to the workpiece. Linear movement of the actuating member 26 along axis 27 causes the first bearing surface to move relative to the contact surface (and relative to the axis 27) so as to provide force to the riser against the second bearing surface. This force causes the riser to pivot about the second bearing surface and separate the riser from the workpiece.

To actuate the breaker assembly 16, hydraulic fluid is provided through fluid delivery assembly 12 to housing 17. Operation of trigger 22 allows hydraulic fluid to flow within housing 17, causing actuating member 26 to move in a downward direction along axis 27 relative to the housing 17. This downward movement of actuating member 26 causes linkage 28 and breaker bit 30 to pivot relative to the bracket assembly 24 and the actuating member 26. In particular, actuating member 26 includes a contact surface 33 that contacts a workpiece having a riser coupled thereto. Breaker bit 30 includes an aperture 34 for receiving the riser of the workpiece and defines a first bearing surface 35 and a second bearing surface 36 opposite the first bearing surface 35. The riser is positioned within the aperture 34 and the actuating member 26 is actuated to pivot the breaker bit 30 relative to actuating member 26. This pivoting action causes the riser to break from the workpiece, wherein bearing surface 35 moves relative to the contact surface 33 to apply force to the riser. This force applied by bearing surface 35 causes riser to pivot about the bearing surface 36.

Figure 3:
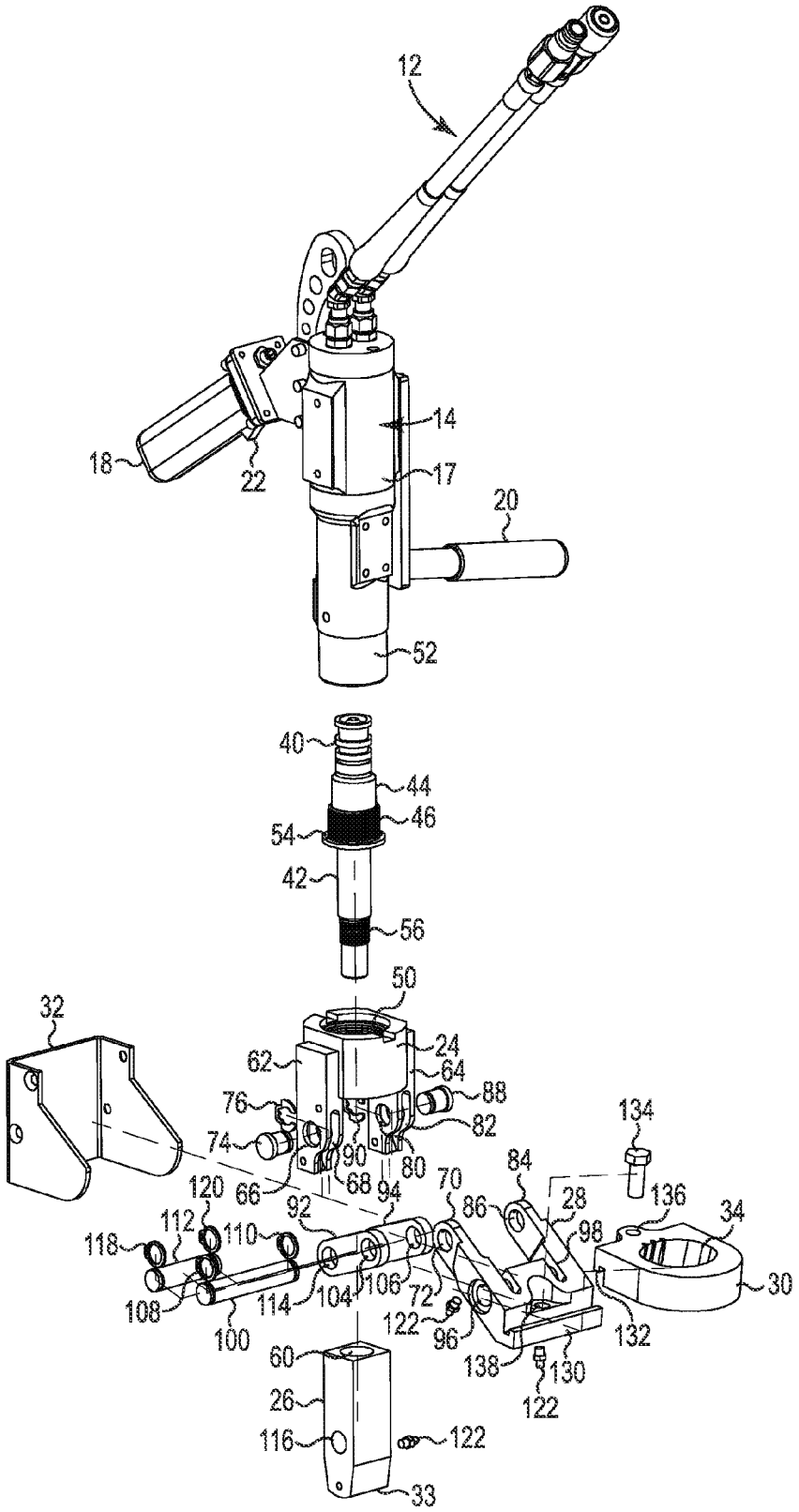
FIG. 3 is an exploded isometric view of the hydraulic tool assembly illustrated in FIG. 2.
Figure 4:
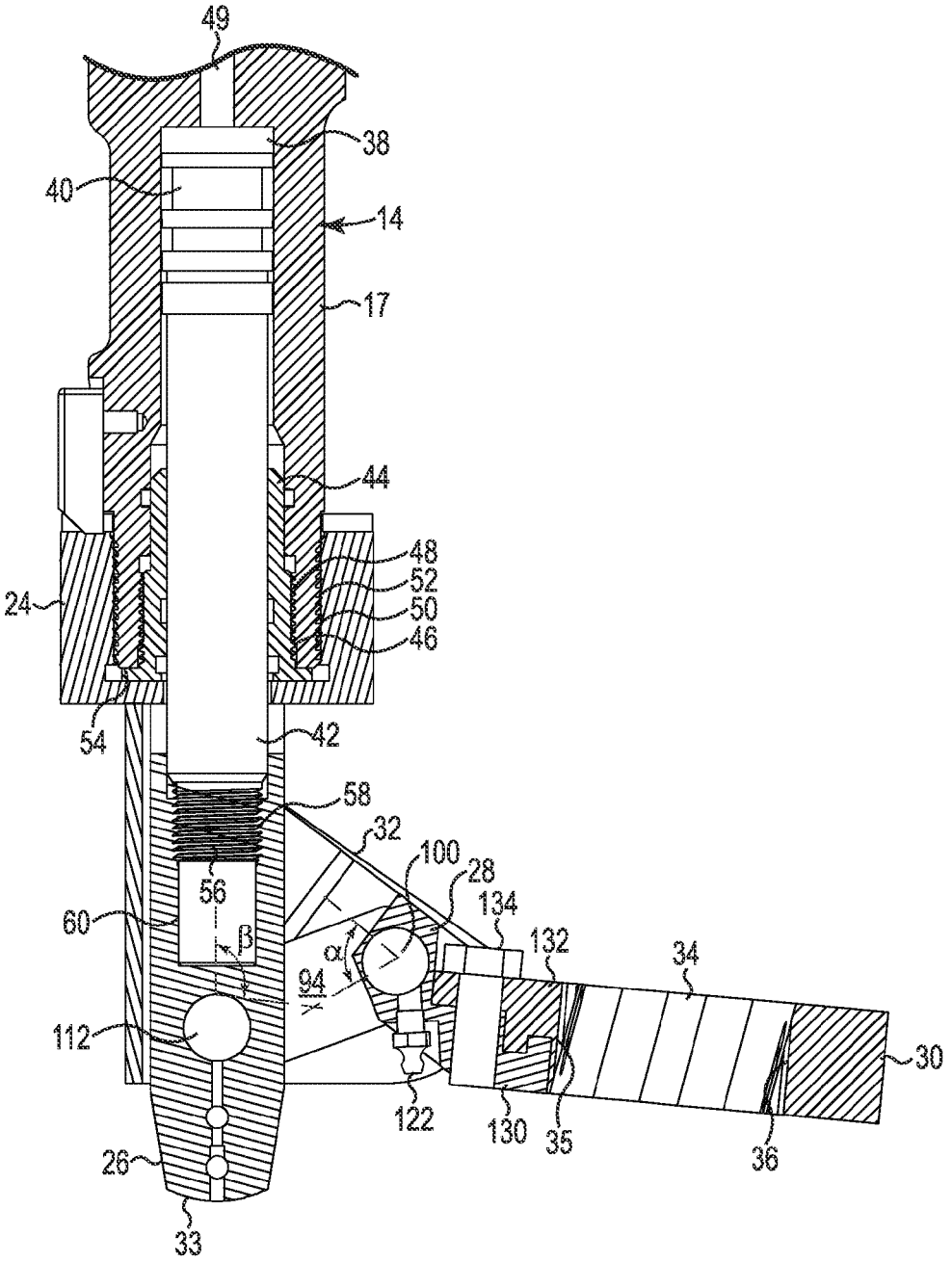
FIG. 4 is a sectional view of the hydraulic tool assembly illustrated in FIG. 2 in a first position.
Figure 5:
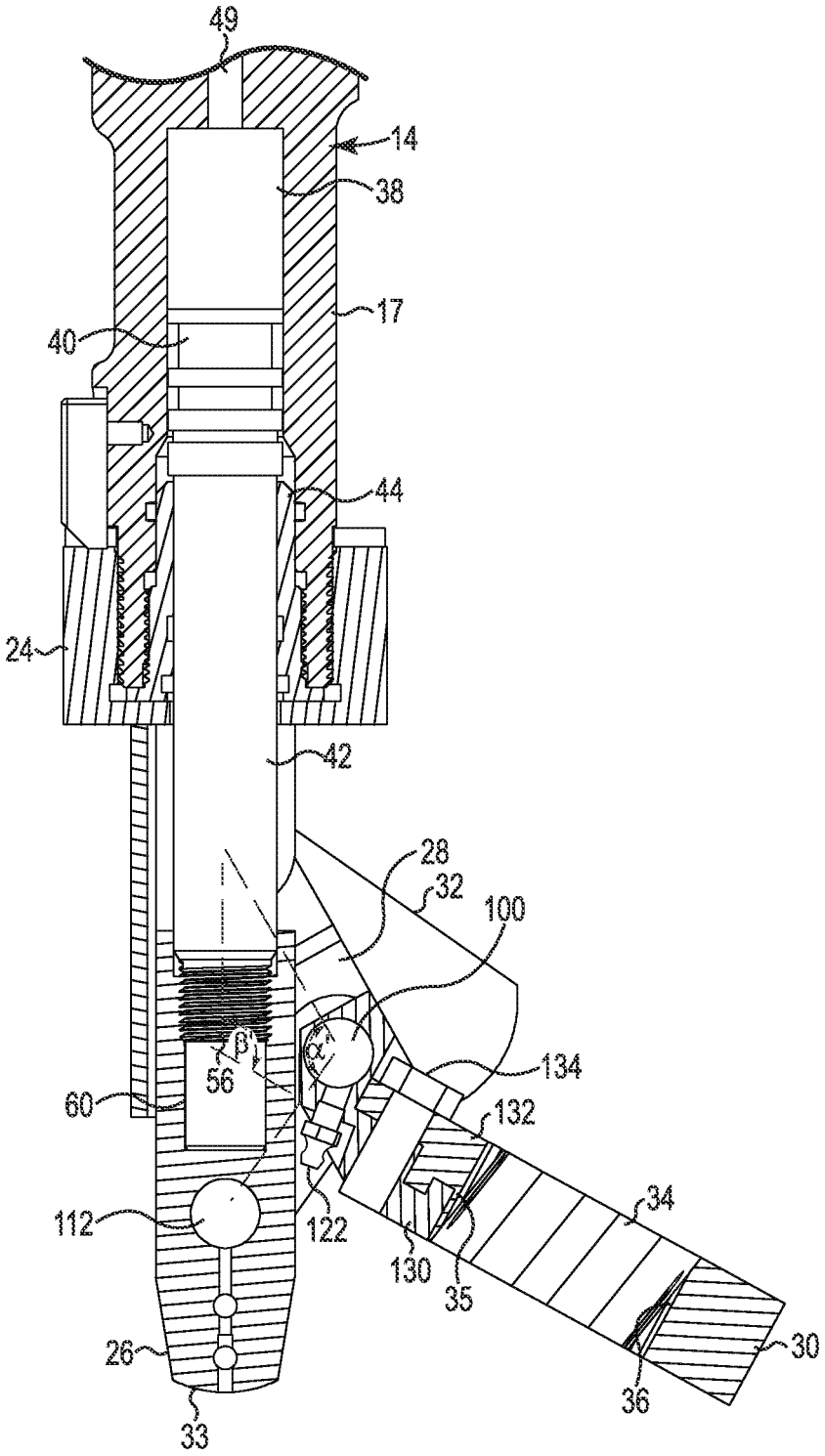
FIG. 5 is a sectional view of the hydraulic assembly illustrated in FIG. 2 in a second position.

With further reference to FIGS. 3-5, positioned within a chamber 38 of the housing 17, a piston 40 is directly coupled with a rod 42. The piston 40 and rod 42 are movable within the chamber 38 with respect to a gland 44 that includes exterior threads 46 engaging interior threads 48 of housing 17. In particular, hydraulic fluid provided from fluid delivery assembly 12 is provide to chamber 38 through an inlet 49. The hydraulic fluid causes piston 40 to move from a first, retracted position (FIG. 4) to a second, extended position (FIG. 5) along axis 27.

Bracket assembly 24 is secured to housing with interior threads 50 that engage exterior threads 52 on the housing 17. A flange 54 on gland 44 locates the gland 44 relative to the housing 17. Rod 42 includes exterior threads 56 that engage interior threads 58 within a bore 60 of the actuating member 26. Due to this connection, movement of piston 40 and rod 42 are directly translated to actuating member 26.

Bracket assembly 24 includes opposed connecting members 62 and 64 extending in a direction away from the housing 17 to couple the bracket assembly 24 to the linkage 28. Connecting member 62 defines an aperture 66 and a slot 68. Linkage 28 includes a first pivoting end 70 having an aperture 72 that is positioned within the slot 68 such that aperture 72 is aligned with aperture 66. A pin 74 and retaining element 76 are positioned within the apertures 66 and 72 in order to connect linkage 28 to connecting member 62. Connecting member 64 is similarly structured to connecting member 62 and includes an aperture 80 and slot 82 for receiving a second pivoting end 84 having an aperture 86 of linkage 28. A pin 88 and retaining element 90 secure end 84 within the connecting member 64. Due to these connections, linkage 28 pivots relative to bracket assembly 24 about pins 74 and 88.

Link arms 92 and 94 are positioned within slots 96 and 98, respectively, of linkage 28 and pivotally connect the linkage 28 with actuating member 26. A pin 100 is positioned within an aperture 102 of linkage 28 and apertures 104 and 106 of link arms 92 and 94, respectively. Retaining elements 108 and 110 secure pin 100 within the aperture 102. Link arms 92 and 94 are further coupled to actuating member 26 with a pin 112. In particular, link arm 92 includes an aperture 114 and link arm 94 includes an aperture (not shown) for receiving pin 112. Actuating member 26 further includes an aperture 116 that receives pin 112. Retaining elements 118 and 120 secure pin 112 to link arms 92, 94 and actuating member 26. If desired, a plurality of grease fittings 122 can be used to provide lubrication to various locations of the tool assembly 10.

Connection among the bracket assembly 24, linkage 28, link arms 92 and 94 and actuating member 26 is defined by a triangular shape, wherein pins 74 and 88 define a first corner, pin 100 defines a second corner and pin 112 defines a third corner of a triangle. As actuating member 26 moves with respect to bracket assembly 24, pin 112 (the third corner) moves with respect to pins 74 and 88 (the first corner). This movement in turn causes pin 100 (the second corner) to move with respect to pins 74 and 88 as well as pin 112 (both the first and second corners). Pins 74 and 88 are in fixed relation to housing 17 and thus movement of the triangle can be defined by movement of the second corner (pin 100) and third corner (pin 112) relative to the first corner (pins 74 and 88). In relation to movement from the first position of FIG. 4 to the second position of FIG. 5, pin 112 moves downwardly away from housing 17. This movement of pin 112 causes link arms 92 and 94, at a point of connection with pin 112, to be pulled in a downward direction away from housing 17. This movement of link arms 92 and 94 causes pin 100 to move in a horizontal direction toward actuating member 26. Pin 100 also causes linkage 28 to pivot in a downward direction, causing breaker bit 30 to pivot in a downward direction.

Linkage 28 includes a lip portion 130 that engages a corresponding lip portion 132 on breaker bit 30. Furthermore, a pin 134 is positioned through an aperture 136 on breaker bit 30 and an aperture 138 on linkage 28 to secure the breaker bit 30 to the linkage 28. Due to connection of linkage 28 with breaker bit 30, breaker bit 30 will pivot along with linkage 28. Stated another way, the breaker bit 30 is in fixed relation with linkage 28 upon final assembly.

During a method of operating hydraulic tool assembly 10, breaker bit 30 transitions from a first position illustrated in FIG. 4 to a second position illustrated in FIG. 5 to remove a riser from a casting. The first position of FIG. 4 can be defined as having the actuating member 26, piston 40 and rod 42 positioned at a first linear distance with respect to the housing 17 and the bearing surface 35 positioned at a first transverse distance (and first angular position) with respect to axis 27. In particular, the piston 40 is proximate the inlet 49 and the actuating member 26 is proximate the bracket assembly 24. Additionally, the bearing surface 35 is extended from the axis 27. The first position can further be defined as linkage 28 and link arms 92, 94 being positioned at an angle $\alpha$ relative to one another. In one embodiment, the angle $\alpha$ is in a range from about 50°-70° and in a particular embodiment is around 60°. The first position can further define an angle $\beta$ between breaker bit 30 and actuating member 26/rod 42. In one embodiment, the angle $\beta$ is in a range around 90°-100° and in one particular embodiment is around 95°.

The second position of FIG. 5 can be defined as the actuating member 26 (as well as piston 40 and rod 42) being positioned at a second linear distance with respect to the housing 17 and the bearing surface 35 positioned at a second transverse distance (and second angular position) with respect to axis 27. The second linear distance is greater than the first linear distance, wherein the first transverse distance is greater than the second transverse distance. The second position is further defined as linkage 28 and link arms 92, 94 being positioned at an angle $\alpha'$ relative to one another. In one embodiment, the angle $\alpha'$ is in a range from about 105°-125° and in a particular embodiment is around 115° when the breaker bit 30 is in the second position. The second position further includes an angle $\beta'$ between breaker bit 30 and actuating member 26/rod 42 being in a range of 110°-130° and in one particular embodiment is around 120°.

In one embodiment, an operator uses handles 18 and 20 to position a riser (not shown) within aperture 34 while breaker bit 30 is in the first position illustrated in FIG. 4. Additionally, actuating member 26, and in particular contact surface 33, is brought into contact with a workpiece (not shown) attached to the riser. The workpiece can be positioned on a support or work surface such that the workpiece is easily accessible to the tool assembly 10. Once the riser is positioned within aperture 34 and the workpiece is in contact with actuating member 26, the operator depresses trigger 22. Depression of the trigger 22 allows hydraulic fluid to pass from fluid delivery assembly 12 through inlet 49 and into chamber 38. As fluid enters chamber 38, piston 40 and rod 42 are forced in a downward direction (i.e., away from inlet 49). This downward movement of the piston 40 and rod 42 is directly translated to the actuating member 26. A path of travel for bearing surface 35 can be characterized as being oblique to axis 27, including both horizontal movement relative to axis 27 and vertical movement along axis 27. As bearing surface 35 and bearing surface 36 are in fixed relation with one another, a path for travel of bearing surface 36 can also be characterized as being oblique to axis 27. In some instances, a riser can be brittle, wherein a path of travel for the bearing surface 35 approximately ⅛" is sufficient to remove the riser.

As discussed above, downward movement of actuating member 26 causes linkage 28 and breaker bit 30 to pivot in a downward direction relative to housing 17. When a riser is positioned within aperture 34 and actuating member 26 is in contact with a workpiece, movement of breaker bit 30 relative to the actuating member 26 causes the riser to separate from the workpiece. In particular, bearing surface 35 places a force on the riser against bearing surface 36. In addition, contact surface 33 is held against the workpiece to assist in providing sufficient force to separate the riser from the workpiece. This force causes the riser to pivot about bearing surface 36 and cause the riser to separate from the workpiece. It is worth noting that the first bearing surface 35 can be positioned on an upper half of the riser to increase leverage of force placed on the riser. To that end, second bearing surface 36 can be positioned on a lower half of the riser to assist in removal of the riser. In any event, vertical displacement (relative to axis 27) of the first bearing surface 35 and second bearing surface 36 can enhance separation of the riser from the workpiece.

Figure 6:
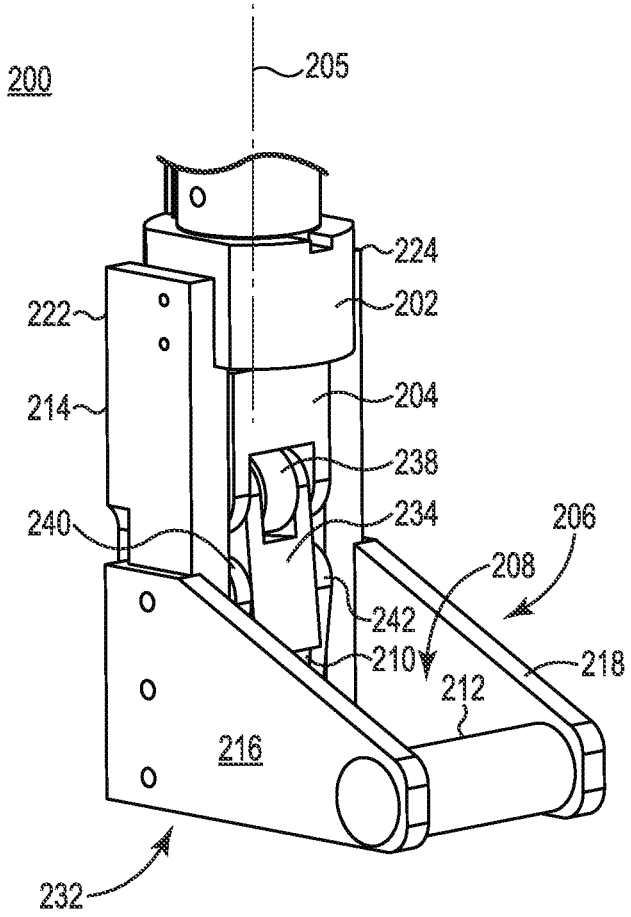
FIG. 6 in an isometric view of an alternative breaker assembly in a first position.
Figure 7:
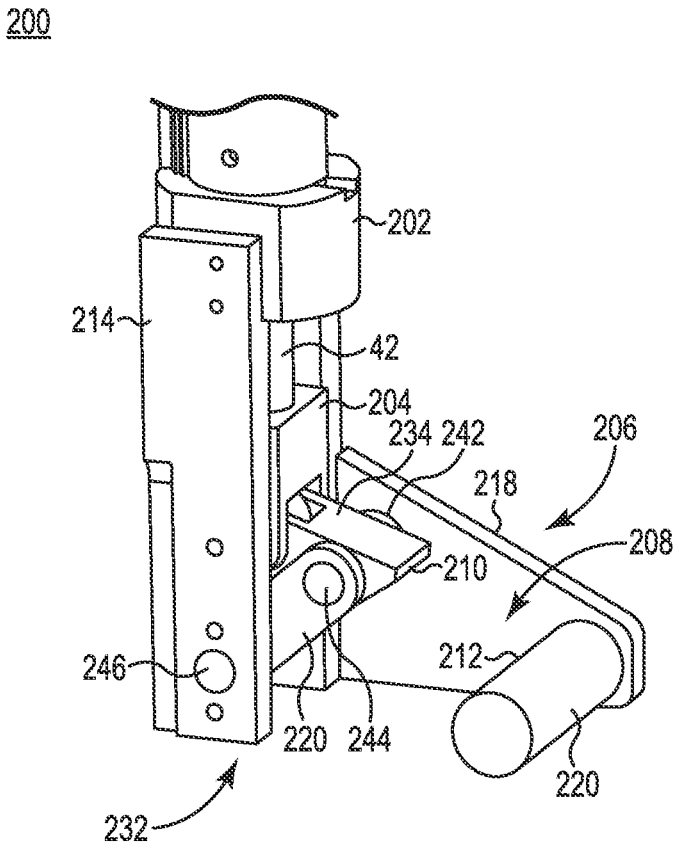
FIG. 7 is an isometric view of the breaker assembly illustrated in FIG. 6 in a second position.
Figure 8:
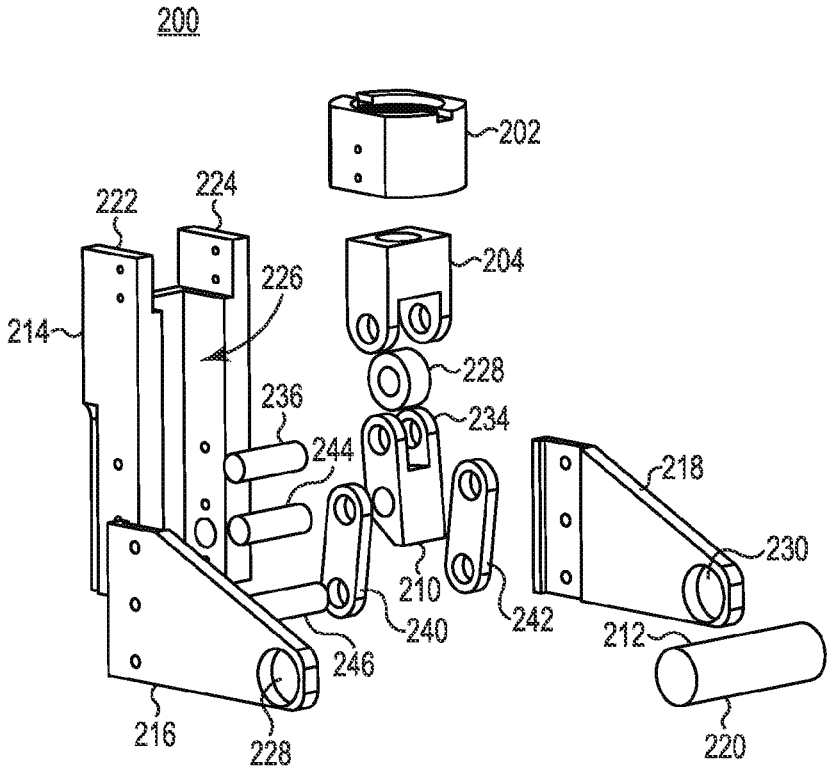
FIG. 8 is an exploded isomeric view of the breaker assembly illustrated in FIG. 6.

FIGS. 6-8 illustrate an alternative breaker assembly 200 that can be coupled with the body assembly 14 illustrated and discussed above with regard to FIG. 2. Breaker assembly 200 is configured to transition from a first position to a second position in order to remove a riser from a workpiece. Breaker assembly 200 includes a bracket assembly 202 and an actuating member 204 configured to move linearly with respect to the bracket assembly 202 along a linear axis 205. In particular, as illustrated in FIG. 7, the actuating member 204 is directly connected to rod 42 in a similar manner to actuating member 26 illustrated in FIG. 2. Breaker assembly 200 further includes a breaker bit 206 (shown generally) that includes an aperture 208, a first bearing surface 210 and a second bearing surface 212.

As actuating member 204 moves away from bracket assembly 202, breaker bit 206 is configured to separate a riser from a workpiece. In contrast to breaker bit 30, bearing surface 210 of assembly 200 moves relative to bearing surface 212 and away from axis 205. Aperture 208 is defined by a guide member 214, opposed transverse brackets 216 and 218 and a pin 220 connected to the opposed brackets 216 and 218. Guide member 214 includes opposed connecting members 222 and 224 that are connected on either side of the bracket assembly 202. The guide member 214 further defines a slot 226 that accommodates movement of actuating member 204. The opposed brackets 216 and 218 extend from a lower portion of the guide member 214 transverse to an axis of movement (axis 205) for actuating member 204. Opposed bracket 216 includes an aperture 228 to secure pin 220 therein. Likewise, bracket 218 includes an aperture 230 to secure pin 220 therein.

Upon final assembly, the guide member 214, bracket 216 and bracket 218 collectively define a contact surface 232 that can be brought into contact with a workpiece to remove a riser therefrom. In an alternative embodiment, only one or two of the guide member 214, bracket 216 and bracket 218 defines a contact surface that contacts a workpiece. In any event, the contact surface 232 provides a surface for generating force to create relative movement between the riser and the workpiece.

Bearing surface 210 is directly coupled and extending from a linkage 234 that is pivotally connected with the actuating member 204. In particular, a pin 236 and bearing 238 are used to secure linkage 234 to actuating member 204. A plurality of link arms 240 and 242 are positioned on either side of the linkage 234 and secured to the linkage 234 with a pin 244. Furthermore, the link arms 240 and 242 are secured to guide member 214 with a corresponding pin 246.

Upon movement of actuating member 204 away from bracket 202, linkage 234, as well as link arms 240 and 242, pivot relative to the actuating member 204. In particular, bearing surface 210 moves away from the guide member 214 and toward the bearing surface 212 from a first transverse distance (and first angular position) relative to axis 205 to a second transverse distance (and second angular position) relative to axis 205. Additionally, a path of travel for the bearing surface 210 is oblique to axis 205. To remove a riser from a workpiece, breaker assembly 200 is positioned relative to the workpiece. In particular, contact surface 232 is positioned on a workpiece whereas the riser is positioned within aperture 208 of breaker bit 206. Actuating member 204 then moves along axis 205 away from bracket assembly 202 in order to actuate bearing surface 210 toward the riser so as to apply a force to the riser. Bearing surface 210 continues movement towards bearing surface 212 until the riser separates from the workpiece and pivots about bearing surface 212. Bearing surface 210 is vertically displaced from bearing surface 212 along axis 205. In one particular embodiment, bearing surface 210 is configured to contact a top half of the riser and the bearing surface 212 is configured to contact a bottom half of the riser.

Movement of breaker assembly 200 to remove a riser from a workpiece can be characterized as transitioning from a first position illustrated in FIG. 6 to a second position illustrated in FIG. 7. The first position includes the linkage 234 (when viewed from pin 236 to bearing surface 210) positioned substantially parallel to axis 205 and actuating member 204 proximate bracket assembly 202. Additionally, bearing surface 210 is proximate axis 205. In the second position, the linkage 234 pivots so as to be substantially perpendicular to axis 205 and actuating member 204 spaced apart from bracket assembly 202. Moreover, the bearing surface 210 is extended away from axis 205 toward second bearing surface 212.

Although the present invention has been described with reference to preferred embodiments, workers skilled in the art will recognize that changes can be made in form and detail without departing from the spirit and scope of the present invention.

What is claimed is:

1. A tool assembly for removing a riser extending along an axis from a surface of a cast metal workpiece, comprising:

a base for supporting the workpiece;

a housing spaced from the base;

an actuator movable relative to the housing;

a riser breaker assembly having a having a first portion movably connected to the housing at a first location, the first portion operably coupled to the actuator, the riser breaker assembly further having a second portion comprising a first bearing surface and a second bearing surface spaced from the first bearing surface, the first and second bearing surfaces capable of contacting opposite sides of the riser;

wherein a movement of the actuator pivots the second portion of the riser breaker assembly wherein a movement of the actuator pivots a second portion of the riser breaker assembly with the first and second bearing surfaces in contact with opposite sides of the riser such that the first and second bearing surfaces are capable of applying a force to the riser axially to displace the riser relative to its axis to separate the riser from the workpiece.

2. The tool assembly of claim 1, wherein a linear movement of the actuator causes a pivotal movement of the second portion of the riser breaker assembly.

3. The tool assembly of claim 1, wherein the first portion of the riser breaker assembly is pivotally connected to the housing.

4. The tool assembly of claim 2, wherein the linear movement of the actuator is along an axis, and wherein the first bearing surface moves obliquely relative to the linear axis when the actuator moves from a first position to a second position.

5. The tool assembly of claim 1, wherein the second portion of the riser breaker assembly is configured to define an aperture, the aperture defining the first and second bearing surfaces.

6. The tool assembly of claim 1 and further comprising a first handle connected to the housing at a first location, and a second handle connected to the housing at a second location, the actuator being actuated by a trigger associated with one of the first and second handles.

* * * * *